United States Patent [19]

Rohner

[11] Patent Number: 4,587,785

[45] Date of Patent: May 13, 1986

[54] ROOFING SHINGLES

[76] Inventor: Nicholas J. Rohner, Delhi, N.Y. 13753

[21] Appl. No.: 624,099

[22] Filed: Jun. 25, 1984

[51] Int. Cl.[4] ..... E04B 2/00

[52] U.S. Cl. ..... 52/420; 52/543

[58] Field of Search ..... 52/415–417, 52/419, 420, 519, 520, 533, 543, 544

[56] References Cited

U.S. PATENT DOCUMENTS

| | | | |
|---|---|---|---|
| 1,887 | 12/1840 | Docker | 52/459 |
| 357,503 | 2/1887 | Redett | 52/417 |
| 1,318,125 | 10/1919 | Zimbelmann | 52/459 |
| 1,447,290 | 3/1923 | Fischer | 52/540 |
| 1,592,014 | 7/1926 | Topping | 52/518 |
| 1,898,989 | 2/1933 | Harshberger | 52/518 |
| 1,955,699 | 4/1934 | Moffit | 52/543 |
| 1,968,281 | 7/1934 | Cale | 52/420 |
| 2,135,811 | 11/1938 | Goslin | 52/552 |
| 2,323,230 | 6/1943 | McAvoy | 52/553 |
| 2,419,843 | 4/1947 | Marten | 52/18 |
| 2,552,159 | 5/1951 | Eason | 52/420 |
| 2,666,402 | 1/1954 | Clarvoe | 52/420 |
| 2,863,405 | 12/1958 | Leibrook | 52/420 |
| 3,050,908 | 8/1962 | Schenk | 52/420 |
| 3,082,577 | 3/1963 | Fasold et al. | 52/543 |
| 3,138,897 | 6/1964 | McCorkle | 52/420 |
| 3,247,631 | 4/1966 | Louness | 52/420 |
| 3,903,340 | 9/1975 | Shepherd | 52/518 |
| 3,962,504 | 6/1976 | Sherwin | 52/420 |
| 4,010,592 | 3/1977 | Nixon | 52/748 |
| 4,194,335 | 3/1980 | Diamond | 52/419 |

FOREIGN PATENT DOCUMENTS

| | | | |
|---|---|---|---|
| 193756 | 4/1919 | Canada | 52/543 |
| 501607 | 4/1954 | Canada | 52/553 |
| 20677 | 12/1917 | France | 52/94 |
| 298438 | 10/1928 | United Kingdom | 52/543 |

*Primary Examiner*—John E. Murtagh
*Assistant Examiner*—Andrew J. Rudy
*Attorney, Agent, or Firm*—John Maier, III

[57] ABSTRACT

A pair of coordinated roofing shingles of the solid variety both with vertical adhesive strips to provide sealing of the shingles with limited nailing and to provide a complete vertical seal at the overlap between adjoining shingles in the same course to prevent water leakage from the horizontal flow of water.

3 Claims, 3 Drawing Figures

ROOFING SHINGLES

BACKGROUND OF THE INVENTION

1. Field of the Invention

The present invention relates to shingles, and more particularly, to a pair of coordinated roofing shingles of the solid type, usually made from either felt or fiberglass covered with asphalt and ceramic granules, and each with at least two vertical adhesive strips to hold down both shingles and to seal the overlap between two adjoining shingles in the same row of shingles so as to prevent the horizontal flow of water at the overlaps. Both of the shingles have a rectangular shape. One of the shingles is of full size with its major edges substantially three times the length of its minor edges. The other shingle is one-half the length of the full-size shingle so that the major edges are only one and one-half times the length of the minor edges. The shingles are placed on a roof with two of the full-size shingles overlapping and above the half-size shingle fitted between them.

2. Description of the Prior Art

In an earlier filed application of the same inventor, Ser. No. 442,597, now U.S. Pat. No. 4,466,226, filed Nov. 18, 1982, a shingle is shown with a series of marks for convenience in cutting the shingle. In the earlier application, a series of methods are taught for installing a roofing shingle with overlapped joints rather than butt joints to assist in avoiding leaks. However, even with two adjoining shingles having an overlapped joint, it is possible, during a heavy rain, or when accumulated ice melts on a roof, that water will flow sideways under the overlap. Even in the absence of these conditions, problems of water flowing sideways occurs on roofs having a low pitch.

In the earlier application, Ser. No. 442,597, a method described as the first method of three is the method most suitable for use with the pair of coordinated shingles according to this invention.

It has been known in the art to provide a strip of adhesive material on shingles so that when the shingles are applied, less nailing is required to secure the shingles to the roof and, after installation, as the heat of the sun warms the roof, the adhesive strip or band on the shingle causes each adjacent higher course or row of shingles to adher to the next lower course or row of shingles thereby preventing shingles from blowing up on end in a high wind. However, in the past, such adhesive bands have been either in a horizontal solid horizontal line or in a series of dots along a horizontal line parallel with the major edges of the shingle and also parallel with the lower edge of the roof. Without doubt, such horizontally oriented adhesive bands do assist in holding down the shingles but, as has been pointed out, water still can flow sideways at the overlapped joints. Unfortunately, with a solid horizontal adhesive strip, the adhesive strip or band itself holds the water in the joint causing it to continue to flow horizontally resulting in a leak.

The novel features which are considered as characteristics of the invention are set forth with particularity in the appending claims. The invention itself, however, as to its construction and obvious advantages will be best understood from the following description of the specific embodiment when read with the accompanying drawings.

SUMMARY OF THE INVENTION

The present invention overcomes the disadvantages of the self-sealing horizontal strip by providing a roofing shingle in the form of a flat sheet of weather resistant material with vertical adhesive bands each having a width of at least one-quarter inch.

DESCRIPTION OF THE DRAWINGS

The present invention may be better understood and its numerous advantages will become apparent to those skilled in the art by reference to the accompanying drawings wherein like reference numerals refer to like elements in the various figures in which.

DETAILED DESCRIPTION OF THE INVENTION

Figure 1:
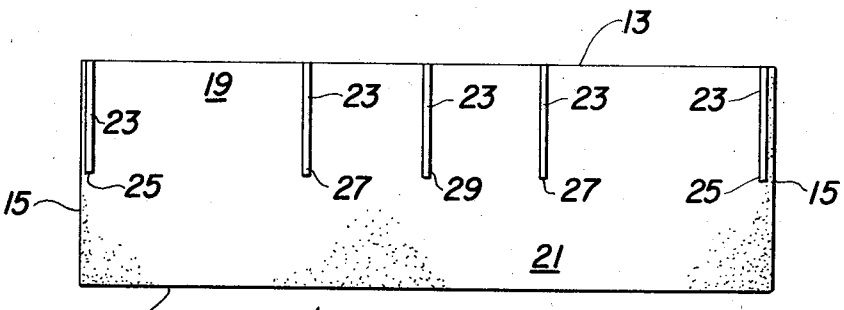
FIG. 1 is a plan view of a full-size shingle showing the adhesive bands in the upper portion of the shingle with a total of five adhesive bands being shown.

Referring to FIG. 1, there is shown a standard size shingle 11 which, in the British system of measurements, has a width of twelve inches and a length of thirty-six inches. A metric size shingle is also available and is just slightly larger than the shingle with British system measurements. The shingle, which has a rectangular shape, has two major edges 13 and two minor edges 15. The major edges 13 are placed substantially horizontally along the horizontal edge of the roof 13 (not shown), and the minor edges 15, which are shorter than the major edges 13, are placed vertically on the roof substantially parallel with the vertical edges of the roof. It is common practice to place shingles side by side, either abutting one another but it is preferable to use an overlap 17 wherein each shingle either overlaps or is overlapped by its adjacent shingle by approximately two or three inches. The larger overlap of three inches has been used on lower courses of shingles in colder climates where a buildup of snow or ice can occur. Two inches is otherwise adequate in the upper portions of the roof and on the entire roof in areas where ice and snow would not accumulate along the lower edge of the roof. With the benefit of this invention, only two inches of overlap 17 is satisfactory at any point on the roof.

The shingles are applied in a series of horizontal rows with each adjacent higher row also overlapping an upper portion 19 of the shingle below it. In the past, more than half of the lower shingle would be covered by the next higher row of shingles but with the advantages of this invention, only one-half of the lower shingle need by covered by the course or row of shingles directly above it.

The major edges 13 of the full-size shingle 11 shown in FIG. 1, whether in the metric or in the British system are substantially three times the length of the minor edges 15. Each full-size shingle 11 has both the upper portion 19 and a lower portion 21. The upper portion 19, as has been pointed out, is covered by the next higher shingle. The lower portion 21 is exposed to the weather. The full-size shingle 11, as shown in FIG. 1, includes five adhesive bands 23. Each of the adhesive bands 23 is a sticky, tar-like material which when heated by the sun will adher to whatever shingle is placed upon it. The length of the five adhesive bands 23 is substantially one-half the length of the minor edges 15 since, as has been pointed out, the upper portion 19 covered the next higher row of course, can be limited to one-half the length of the minor edges 15 but it can be increased if desired. The five adhesive bands 23 are all located in the upper portion 19 of the full-size shingle 11. All of the five adhesive bands 23 are substantially parallel to one another and to the minor edges 15 of the full-size shingle 11 shown in FIG. 1. Each has a width of at least one-quarter of an inch. Preferable, the adhesive bands 23 would have a width of three-eighths of an inch and may even be as wide as one-half inch.

Included within the five adhesive bands 23 are an outside pair of adhesive bands 25 which are located along the minor edges 15 of the full-size shingle 11 and just slightly removed from the minor edges 15. An intermediate pair of adhesive bands 27 are located at the one-third and two-third points as measured along the major edges 13 of the full-size shingle 11. One edge of the intermediate pair of adhesive bands 27 is at the one-third and two-thirds point line with each of the intermediate adhesive bands 27 within the one-third part of the full-size shingle closest to the nearest minor edge 15.

A middle adhesive band 29 is located substantially along the centerline between the two minor edges 15.

Figure 2:
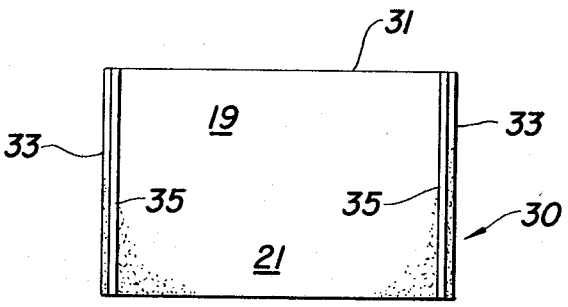
FIG. 2 is a plan view of the half shingle with one pair of adhesive bands substantially the same length as the minor edges of the shingle and located adjacent the minor edges.

Referring now to FIG. 2, the smaller or half-size shingle 30 is shown. The half-size shingle 30, like the full-size shingle 11, includes the upper portion 19 and the lower portion 21. This shingle also has a pair of major edges 31 and a pair of minor edges 33. The major edges 31 are approximately one and one-half times the length of the minor edges 33. The minor edges 33 of the half-size shingle 30 are substantially the same length as the minor edges 15 of the full-size shingle 11. With the half-size shingle 30, only one pair of adhesive bands 35 are on the shingle 30. Again, each of the adhesive bands 35 should be at least one-quarter inch in width as with the larger or full-size shinge 11. However, with the half-size shingle 30, shown in FIG. 2, each of the adhesive bands 35 is substantially as long as the minor edge 33 and located adjacent each of the minor edges 33 of the half-size shingle 30 in a similar manner to the pair of outside bands 25 of the full-size shingles 11.

Figure 3:
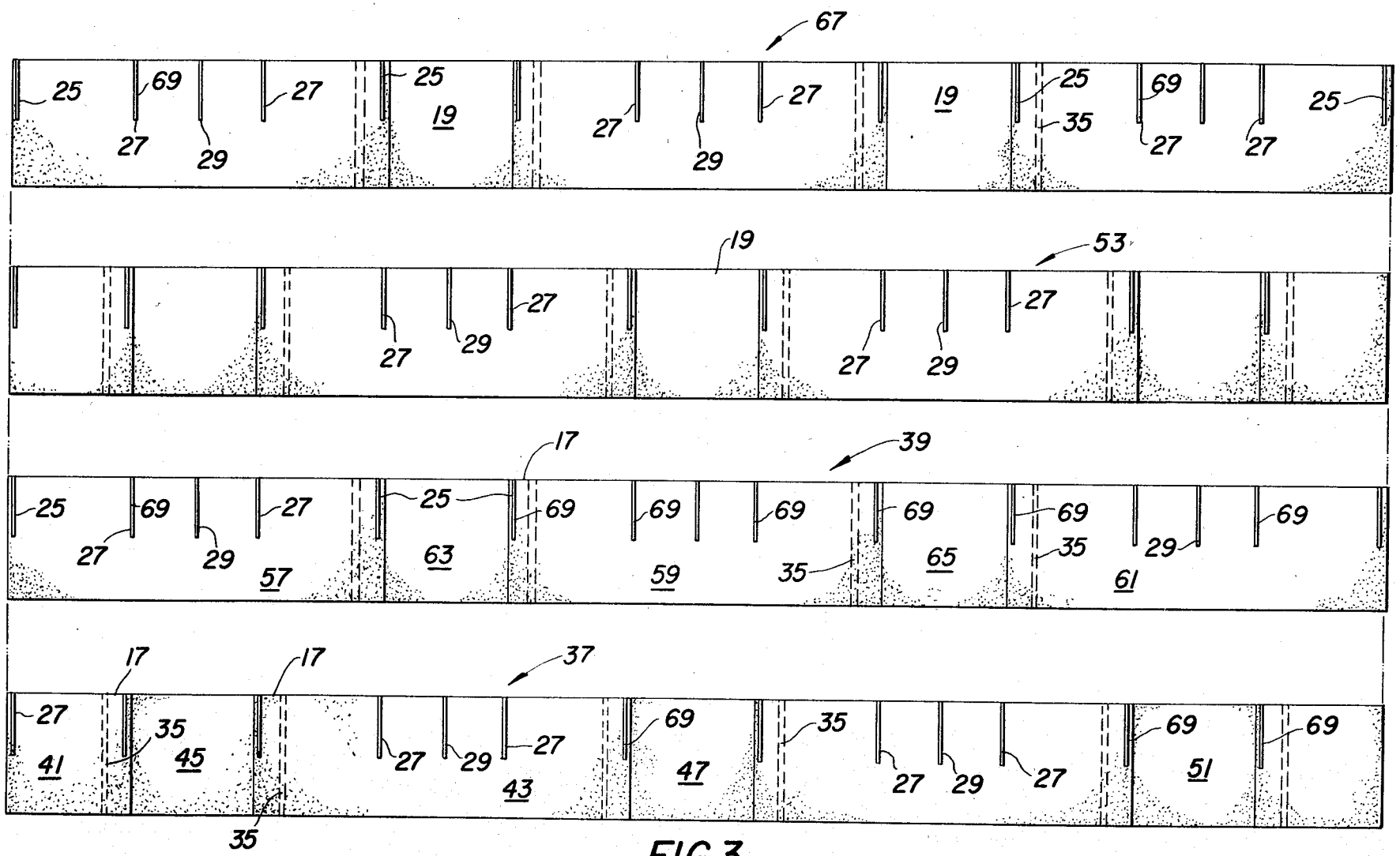
FIG. 3 is an exploded view of both the full-size and half-size shingles according to this invention shown apart but arranged as they would overlap one another on a roof.

Referring now to FIG. 3, a method is shown, which is taught in applicant's earlier patent application, previously referred to herein. The first or lowest course of shingles shown in FIG. 3 is a base course 37 which is the first or runner set of shingles placed across the roof before laying a first course 39 which is the first course that is exposed. The first shingle 41 which starts the base course 37 is a full-length shingle 11 cut to a one-third length. Since the intermediate pair of adhesive bands 27 are located within the one-third part of the full-size shingle 11 adjacent its nearest minor edge 15 one of the intermediate adhesive bands 27 is on the one-third shingle to assist in securing the next course. The third shingle 43 in the base course 37 is a full-length, full-size shingle 11. Placed between the first shingle 41 in the base course 37 and the third shingle 43 in the base course 37 is a second shingle 45 which is a one half-size shingle 30. Both minor edges 33 of the half-size shingle 30 are placed beneath the ends of the first shingle 41 and the third shingle 43. The space between the first shingle 41 and the third shingle 43 is one-third the length of a full-size shingle 11. Since the second shingle 45 is a one-half shingle 30, there is the overlap 17 between both the first shingle 41 and second shingle 45 and the second shingle 45 and third shingle 43 is adequate. The adhesive bands 35 of the half-size shingle 30 are shown as dotted lines in the base course 37 in FIG. 3. A fourth shingle 47 is again a half-size shingle 30 and a fifth shingle 49 is a full-size shingle 11 and a sixth shingle 51 is a half-size shingle 30 with the same spacing and the same overlap as described for the first shingle 41, the second shingle 45 and the third shingle 43 of the base course 37. It should be noted that a second course 53 follows the same procedure and sequence as the base course 37.

Referring now to the first course 39, the first shingle 57 is a full-size shingle 11. Had a full-size shingle 11 been used as the first shingle in the base course 37, a one-third shingle would have been used in the first course 39 with the same resultant changes in successive courses. A third shingle 59 is also a full-size shingle 11 spaced from the first shingle 57 along the first course 39 a distance of one-third the length of a full-size shingle 11. A fifth shingle 61, also a full-size shingle 11 is placed the same one-third distance from the third shingle 59. A second shingle 63 and the fourth shingle 65 of the second course 53 are half shingles 30 and the second shingle 63 is placed between the first shingle 57 and the third shingle 59 and the fourth shingle 65 is placed between the third shingle 59 and fifth shingle 61 in the same manner as was done in the base course 37. It should be noted that the first course 55 is directly and completely over the base course 37 so that none of the base course 37 is exposed.

The second course 53 follows the same description as the base course 37. The second course 53, however, only partially overlaps the first course 39 covering only the upper portion 19 of the full-size shingles 11 and the half-size shingles 30. However, looking at the first course 39 and the second course 53, it can be seen that the full-size shingle 11 will touch and be sealed down by one of the intermediate pairs of adhesive bands 27 and middle bands 29 located on the shingles directly below it and the pair of adhesive bands 35 of the half-size shingle 30 will completely seal the entire course to prevent leakage from the horizontal flow of water. Both the intermediate pair of adhesive bands 27 and the middle adhesive band 29 serve to hold the higher row of shingles down securely.

The third row 67 of shingles follows the same description as the first row 39 of shingles. In each of the rows 37, 39, 53, 67, a half-size shingle 30 is alternated with a full-size shingle 11 and each full-size shingle 11 has a half-size shingle 30 centrally aligned with it in the next higher row.

The use of nails 69 would be limited and preferable would be placed toward the lower ends of the outside pair of adhesive bands 25 and the intermediate pair of adhesive bands 27.

While a preferred embodiment has been shown and described, various modifications and substitutions may be made without departing from the spirit and scope of this invention. Accordingly, it is understood that this invention has been described by way of illustration rather than limitation.

I claim:

1. A pair of coordinated roofing shingles for use in covering a roof by placing a series of rows of shingles with each two overlapping the adjacent lower row on the roof, said pair of shingles comprising:

a full-size shingle including a flat sheet of weather resistant material having a rectangular shape with two minor edges having a length, two major edges, and an upper portion and a lower portion, the major edges of the full-size shingle being substantially three times the length of the minor edges of the full-sized shingle, said full-size shingle further including five adhesive bands, each of the five adhesive bands being generally parallel with the two minor edges of the full-size shingle and located in the upper portion of the full-size shingle, two of the adhesive bands being located adjacent the minor edges of the full-size shingle and two of the adhesive bands being located with one edge a distance of one-third the length of each major edge from opposite minor edges and and one single adhesive band being located along the centerline of the full-size shingle; and a half-size shingle including a flat sheet of weather resistant material having a rectangular shape with two minor edges each edge having a length and two major edges and an upper portion and a lower portion, the major edges of the half-size shingle being substantially one and one half times the length of the minor edges of the half-size shingle, the minor edges of both the half-size shingle and the full-size shingle being substantially the same, said half-size shingle further including two adhesive bands, each of the two adhesive bands being generally parallel with the two minor edges of the half-size shingle and being located adjacent the minor edges of the half-size shingle for the full length of the minor edges of the half-size shingle, the upper portion of both the full-size shingle and the half-size shingle being adapted to be covered by the next higher row of shingles and the lower portion of both the full-size shingle and the half-size shingle being adapted to be exposed, said full-size shingle and said half-size shingle being adapted to be alternated in the same row with each full-size shingle having a half-size shingle centrally aligned with a full-size shingle in the next higher row.

2. A pair of coordinated roofing shingles according to claim 1 wherein the adhesive bands of the full-size shingle are substantially one-half the length of the minor edges.

3. A pair of coordinated roofing shingles according to claim 1 wherein the adhesive bands have a width of at least one-quarter inch.

* * * * *